US005733701A

United States Patent [19]

Anno et al.

[11] Patent Number: 5,733,701

[45] Date of Patent: Mar. 31, 1998

[54] NON-CONTACT HOT FUSING TONER

[75] Inventors: Masahiro Anno, Sakai; Minoru Nakamura, Itami; Makoto Kobayashi, Settsu, all of Japan

[73] Assignee: Minolta Co., Ltd., Osaka, Japan

[21] Appl. No.: 708,506

[22] Filed: Sep. 5, 1996

[30] Foreign Application Priority Data

Sep. 19, 1995 [JP] Japan ..... 7-239817
Nov. 10, 1995 [JP] Japan ..... 7-293111

[51] Int. Cl.[6] ..... G03G 9/097

[52] U.S. Cl. ..... 430/110; 430/137

[58] Field of Search ..... 430/106, 110, 430/111, 137

[56] References Cited

U.S. PATENT DOCUMENTS

| | | | |
|---|---|---|---|
| 4,352,877 | 10/1982 | Narusawa et al. | 430/97 |
| 4,355,088 | 10/1982 | Westdale et al. | 430/98 |
| 4,386,147 | 5/1983 | Seimiya et al. | 430/99 |
| 4,578,338 | 3/1986 | Gruber et al. | 430/120 |
| 4,698,290 | 10/1987 | Berkes | 430/124 |
| 4,699,863 | 10/1987 | Sawatari et al. | 430/97 |
| 4,910,113 | 3/1990 | Mori et al. | 430/106 |
| 4,917,982 | 4/1990 | Tomono et al. | 430/99 |
| 4,994,520 | 2/1991 | Mori et al. | 524/547 |
| 5,023,158 | 6/1991 | Tomono et al. | 430/99 |
| 5,171,653 | 12/1992 | Jugle et al. | 430/108 |
| 5,322,752 | 6/1994 | Gay | 430/37 |
| 5,389,485 | 2/1995 | Katagiri et al. | 430/110 |
| 5,413,890 | 5/1995 | Mori et al. | 430/137 |
| 5,547,797 | 8/1996 | Anno et al. | 430/110 |

*Primary Examiner*—John Goodrow
*Attorney, Agent, or Firm*—Burns, Doane, Swecker & Mathis, LLP

[57] ABSTRACT

Toner for use in a non-contact heat fusing apparatus. Toner includes a binder resin, a colorant and acicular particles of wax. In a preferred embodiment, the toner includes a carbon black graft polymer obtained by reacting carbon black and a polymer which is reactive with the carbon black.

22 Claims, 1 Drawing Sheet

NON-CONTACT HOT FUSING TONER

BACKGROUND OF INVENTION

1. Field of Invention

The present invention relates to a toner for developing electrostatic latent images formed by electrostatic recording image forming methods. More specifically, it relates to a toner for use with noncontact-type hot fusing methods such as flash fusing methods, oven fusing methods and similar methods.

2. Description of the Related Art

In conventional image forming methods, such as electrophotographic methods and the like, there are various types of methods used to fuse a toner image which has been transferred onto a transfer sheet. Such fusing methods include pressure fusing methods which do not use heat, contact-type hot fusing methods such as hot roll fusing methods, and noncontact-type hot fusing methods such as the flash fusing methods and oven fusing methods.

Since toners require different characteristics depending on the fusing method used, the toners must have characteristics suitable for the respective fusing methods. When considering the colorization and high-speed performance required by image forming methods in recent years, the pressure fusing methods are deemed unsuitable due to the limitations of toners. As a result, hot roll fusing methods and flash fusing methods have become the focus of attention.

In hot roll fusing methods, toner image fusion is accomplished by passing a transfer sheet bearing a toner image between a pair of heated rollers. This may result in offset development wherein the toner on the transfer sheet adheres to the heated roller. For this reason, a separation agent such as silicone oil must be applied to the hot roll or an anti-offset agent must be included in the toner.

The flash fusing methods, on the other hand, are methods wherein a toner image carried on a transfer sheet is irradiated by flashes from a discharge tube such as, for example, a xenon flash or similar flash, so as to melt the toner and fuse it to the transfer sheet. Noncontact heat fusing methods, such as the aforesaid flash fusing method and similar methods, do not produce the offset development which occurs in hot roll fusing methods. Offset development does not occur because the toner image on the transfer sheet is melted and fused without contact with a roller.

The use of image forming apparatuses such as copiers and similar devices has increased in recent years. The increasing variety of uses of such apparatuses has likewise increased requirements for image quality. Requirements for image quality include high image density, fine line reproducibility, halftone quality, image textures and accurate reproducibility relative to generation copies. In addition, particularly excellent fine line reproducibility and halftone quality are required in digital image forming apparatuses.

Among these requirements, fine line reproducibility, halftone quality, image texture, and accurate reproducibility of generation copies are characteristics which are highly dependent on the particle size of the toner. It is proposed that a small size toner should be used having a mean particle size of less than 10 μm. When small size toner is used in noncontact heat fusion methods, there is a tendency toward reduced fusion strength. There is also a tendency toward reduced soiling characteristics (referred to as "smearing" hereinafter) on the surface of the transfer sheets.

Smearing is caused by rubbing together of images as the toner particle size becomes smaller. When smearing is severe, e.g., when forming images such as bar codes and similar images, image quality is reduced by rubbing. This reduces bar code verifiability.

In recent years, there has been a tendency to increase the amount of additives including colorants such as carbon black and similar colorants. These additives reduce toner consumption and increase the opacifying power of the toner, which tends to diminish smear characteristics.

In general, flash-fused toners use carbon black dispersed in a thermoplastic resin by fusion kneading. However, the dispersed state of carbon black is, for example, nonuniform, such that images of superior texture cannot be reproduced due to flocculation of the carbon black during the flash fusion process.

As previously described, it has been proposed to use small size toner having a mean particle size of less than 10 μm because image quality is controlled by toner particle size. However, the various types of toner components must be even more uniformly dispersed with small particle size toners. When the dispersion state is inadequate due to the presence of flocculated carbon black, the toner surface becomes irregular, the charge distribution of the developer becomes broader, the amount of inadequately charged toner increases, and toner flow characteristics deteriorate.

Since reflocculation of the carbon black in the softened toner occurs during the flash fusion process, even the use of smaller size toner does not produce excellent high quality images. That is, when reflocculation of the carbon black occurs during flash fusion, the area without carbon black increases. As a result, when the toner is fused to the sheet in this condition, there is a plurality of small white spots in the image, and defects in fine lines appear, thereby diminishing reproducibility. This condition can be readily viewed when the image is enlarged.

SUMMARY OF INVENTION

The present invention is a toner for developing electrostatic latent images formed by electrostatic recording image forming methods. The toner is used with noncontact-type hot fusing methods such as flash fusing methods and oven fusing methods.

An object of the present invention is to eliminate the previously described disadvantages by providing a toner with excellent smear characteristics for use in noncontact hot fusing methods.

Another object of the present invention is to provide a noncontact hot fusing toner capable of reproducing images having high image density, and excellent fine line reproducibility and halftones.

Still another object of the present invention is to provide a toner which prevents reflocculation of carbon black during the flash fusion process, and which is capable of stably reproducing images of high quality.

A further object of the present invention is to provide a developer having excellent stability and charge rise characteristics in a toner of small particle size, and which is capable of reproducing high resolution images without image noise caused during printing.

A still further object of the present invention is to provide a developer having excellent flow characteristics even in a toner of small particle size, excellent uniformity of the developer layer in a monocomponent developer, excellent mixing characteristics with a carrier in a two-component developer, and excellent toner replenishment characteristics.

DETAILED DESCRIPTION OF PREFERRED EMBODIMENTS

In the present invention, the toner used has a weight-average particle size of 2 to 9 μm, and preferably 3 to 8 μm, to produce high quality images. It is desirable that the toner have a particle distribution such that the content of particles which are two or more times the weight-average particle size is less than 2 percent-by-weight, and preferably less than 1 percent-by-weight. It is also desirable to have a content of particles which are less than ⅓ the weight-average particle size of less than 5 percent-by-weight.

A toner having the desirable weight-average particle size and particle size distribution is capable of accurately reproducing fine lines of a latent image formed on a photosensitive member. Such a toner also has excellent reproducibility of dot latent images in digital images and produces images having excellent halftones qualities and resolution.

Such a toner is capable of producing excellent images with stable toner consumption which is less than the consumption of conventional toners, even when making continuous copies or printouts. This improves toner economic characteristics. The toner of the present invention uses less toner than a conventional toner to produce comparable image densities due to the effectiveness of the particle size.

In general, image quality, as well as the verification rate of bar code patterns and similar patterns, is improved as the particle size of the toner becomes smaller. However, stable verification rates cannot be assured in the case of conventional particle size toners due to the reduced smear characteristics of the image on the transfer sheet. Thus, stable production of high quality images cannot be obtained by simply reducing the toner particle size.

The toner of the present invention improves smear characteristics and fusion characteristics for a small particle size toner used in a noncontact hot fusing process. This is achieved by a plurality of dispersion of polyolefin wax as acicular particles in a toner.

Figure 1A:
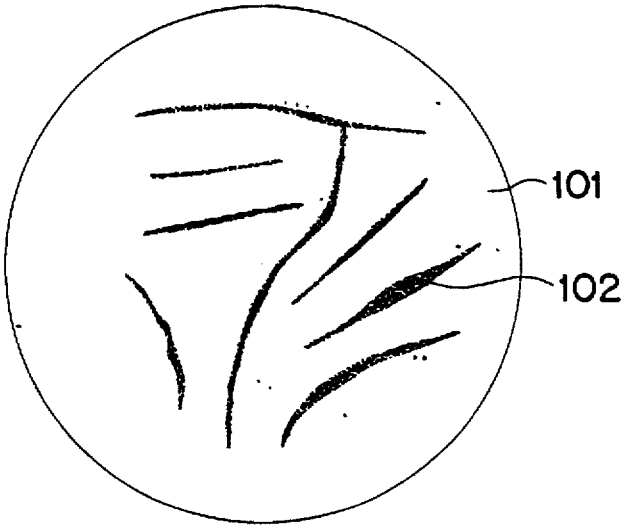
FIG. 1(A) is a section view of the noncontact hot fusing toner of the present invention.
Figure 1B:
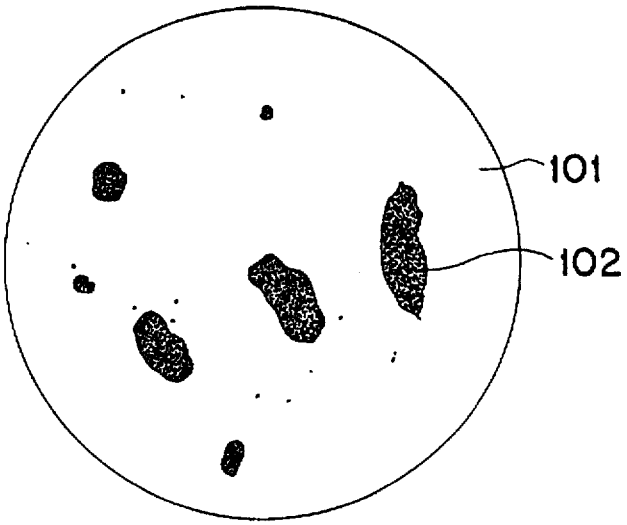
FIG. 1(B) is a section view of a conventional toner.

The toner of the present invention shown in FIG. 1(A) is a dispersion of polyolefin wax 102 as acicular particles in a binder resin 101. The toner shown in FIG. 1(B) is a dispersion of polyolefin wax 102 as granular particles in a binder resin 101.

The acicular particles of polyolefin wax in the present invention have a relative length ratio of 5 to 40, preferably a ratio of 8 to 30, and ideally a ratio of 20 to 25. The relative length ratio of the acicular particles expresses the mean value of the ratio between the maximum length of the acicular particle (length of particle) and the maximum diameter of the acicular particle (breadth of the particle). Standardizing of the diameter of the acicular particles by the maximum value of the diameter (breadth) allows a view of the acicular particle having a center portion which is somewhat thicker than the end portions in the length direction.

The average length of the aforesaid polyolefin wax acicular particles is 0.5 to 8 μm, and preferably 1.0 to 4.0 μm. The average diameter (breadth) of the acicular particles is 0.005 to 0.5 μm, and preferably 0.05 to 0.3 μm. The relative length ratio, average length, and average diameter of the acicular particles were measured by photographic enlargement of a section of toner particle sectioned by microtome and viewed by a transmission electron microscope (TEM).

The reasons for the effective improvement of smear characteristics by the dispersion of polyolefin wax acicular particles in the present invention are not clearly understood. However, what are believed to be the pertinent factors are described below.

It is believed that when polyolefin wax is added, the wax in the toner eluates to a part of the surface during hot fusion. This makes friction with the paper difficult due to the slidability of the wax. The wax present within the toner which has not eluated to the surface is incompatible with the binder resin which forms the toner and provides an interface with the binder resin. As the area of this interface becomes larger, there is shearing of this interface of the wax and resin when the toner image rubs the sheet. This shearing causes soiling, i.e., smearing, on the sheet.

Therefore, it is believed that when granular particles of wax are present in the toner, smear characteristics are reduced due to the increased area of the interface of resin and wax. In addition, it is difficult for the wax present in the center of the toner to eluate to the surface even when finely dispersed. As a result, this wax cannot participate in improving smear characteristics.

The present invention produces an improvement in smear characteristics by dispersion of polyolefin wax acicular particles in the toner based on the aforesaid knowledge. It assures excellent slidability due to the dissolving of the wax from the areas near the surface of the toner containing wax acicular particles during noncontact hot fusion. Furthermore, the wax remaining within the toner which does not dissolve to the surface does not readily shear due to the small area of the interface with the binder resin. As a result, excellent smear characteristics are obtained.

The polyolefin wax used in the present invention may be a polyethylene wax, polypropylene wax or a similar wax. Polyethylene wax is particularly desirable from the perspective of improving smear characteristics. This is believed to be due to the excellent slidability of polyethylene wax. The wax used desirably has a softening point (JIS K2207) of 80° to 150° C., preferably 90° to 140° C., and ideally 100° to 130° C. The molecular weight determined through the viscosity method will be 800 to 10,000, and preferably 1,000 to 5,000.

When the softening point is lower than 80° C. or when the molecular weight is less than 800, there is a tendency for the toner to be susceptible to blocking and deterioration of heat resistance. Furthermore, when the softening point is higher than 150° C. or when the molecular weight is greater than 10,000, the improvement of smear characteristics tends to be reduced.

Specific examples of the polyolefin wax with the previously described characteristics include polyethylene waxes such as Mitsui Hi Waxes 100P, 200P, 400P, and 800P (Mitsui Petrochemical Industries, Ltd.), SanWaxes LEL-250, LEL-800, LEL-400 (Sanyo Chemical Industries, Ltd.) and similar waxes. Other examples are polypropylene waxes such as Biscol 330P, 550P, 600P, 660P, 100TS, TS200 (Sanyo Chemical Industries, Ltd.) and similar waxes.

In order to improve the dispersability of the wax in the toner, it is desirable to use graft-transformed polyolefin. Graft-transformed polyolefin wax is a wax obtained by graft polymerization of a polymerizable monomer to a polyolefin wax. The graft-transformed polyolefin wax used need not have a functional group. It is particularly desirable to use both a polyolefin wax and a graft-transformed polyolefin wax in combination. Graft-transformed polyethylene waxes may be used as the graft-transformed polyolefin wax, and are particularly efficacious in the present invention.

Examples of useful graft-transformed polyolefin waxes include styrene-transformed polyethylene waxes such as Mitsui HiWaxes 1120H, 1140H, 1160H, 2235H (Mitsui Petrochemical Industries, Ltd.) and similar waxes. Other examples are styrene-acrylic-transformed polyethylene waxes such as Mitsui HiWax 3010R (Mitsui Petrochemical Industries, Ltd.) and similar waxes, for example. When styrene resin is used as the binder resin, it is particularly desirable to use a polyolefin wax graft-transformed by styrene from the perspective of improved dispersability of the wax.

In the present invention, the amount of wax used is 0.5 to 5 parts-by-weight, and preferably 1 to 4 parts-by-weight, relative to 100 parts-by-weight of binder resin. When an inadequate amount of wax is used, sufficient effectiveness cannot be obtained. When an excessive amount of wax is used, not only does inadequate effectiveness result, but other adverse affects result. Such adverse results include reduced flow characteristics, deterioration of chargeability, and soiling of the photosensitive member by filming and similar processes.

It is desirable that the toner of the present invention may be regulated by well known methods insofar as said toner has a dispersion of polyolefin wax in the previously described state. From the perspective of small particle size toner manufacturability, it is desirable that the toner used is regulated by a wet granulation method. Such methods include suspension polymerization and emulsion dispersion. However, this would not include a toner produced by a kneading pulverization method.

In the suspension polymerization method, resin particles containing colorant are formed through dispersion of a resin. The resin desirably comprises at least a polymerizable monomer and colorant, in which the monomer is polymerized. The resin is in a dispersion medium such as an aqueous medium in which the resin is insoluble. The monomers within the particles are polymerized. The dispersion medium is then removed and the particles dried to obtain the toner particles.

In the emulsion dispersion method, resin particles containing colorant are formed through dispersion of at least a thermoplastic resin, colorant, and solvent in which said resin is soluble. These components are in a dispersion medium such as an aqueous medium which is incompatible with the solvent and in which the resin is insoluble. The solvent is removed from the particles, the dispersion medium is removed, and the particles dried to obtain toner particles.

The production of toner particles through the suspension dispersion method is described hereinafter in detail. This is an example of a method for producing the toner of the present invention.

A polymerizable monomer and polyolefin wax are mixed in a predetermined proportion. The materials are heated to melt the polyolefin wax present in the polymerizable monomer. Then, the material is quickly cooled under high speed mixing to separate out the wax as acicular particles. The heating temperature T1 when dissolving the polyolefin wax relative to the softening temperature Tm of the polyolefin wax is desirably $Tm-30° C. \leqq T1 \leqq Tm$, preferably $Tm-25° C. \leqq T1 \leqq Tm-5° C.$, and ideally $Tm-20° C. \leqq T1 \leqq Tm-10° C.$ The temperature T2 for quickly cooling the polymerizable monomer material in which the polyolefin wax is dissolved relative to the softening point Tm of the polyolefin wax is desirably $Tm-150° C. \leqq T2 \leqq Tm-80° C.$, preferably $Tm-100° C. \leqq T2 \leqq Tm-90° C.$, and ideally $Tm-150° C. \leqq T2 \leqq Tm-100° C.$ A colorant is added to the polymerizable monomer in which is dispersed the polyolefin wax acicular particles. This polymerizable monomer material is subjected to suspension dispersion in an aqueous medium to form particles. Resin particles are formed by polymerizing the monomers within these particles. The dispersion medium is then removed and the particles dried to obtain the toner of the present invention.

As disclosed in Japanese Unexamined Patent Application No. HEI 5-333597, resin particles containing a dispersion of colorant and wax acicular particles in an aqueous medium are flocculated by heating in the aqueous medium and drying the flocculant. The flocculant is then cracked to obtain amorphous toner particles.

The binder resin used by the present invention is not particularly limited and may be a typical known toner binder resin. Examples of useful binder resins include thermoplastic resins such as polystyrene resin, poly(meth) acrylic resin, polyolefin resin, polyamide resin, polycarbonate resin, polyether resin, polysulfone resin, polyester resin, epoxy resin and similar resins, and copolymers, block polymers, graft polymers, and polymer blends thereof.

The resin used as a binder resin in the toner of the present invention may be, for example, a resin in a complete polymer state such as a thermoplastic resin. The resin may also be an oligomer or prepolymer, or resins containing crosslinking agents and similar compounds.

Organic and inorganic dyes and pigments may be used as colorants. These include carbon black, disazo yellow pigment, insoluble azo pigment, copper phthalocyanine pigment, basic dye, oil soluble dye and similar compounds. Specifically, carbon black is desirable for black color toners, and carbon black graft polymers are particularly desirable from the perspective of dispersability.

Useful color toners include pigments such as C.I. pigment yellow 12, C.I. pigment yellow 13, C.I. pigment yellow 14, C.I. pigment yellow 15, C.I. pigment yellow 17, C.I. pigment red 2, C.I. pigment red 3, C.I. pigment red 6, C.I. pigment red 7, C.I. pigment blue 15, C.I. pigment blue 16 and similar pigments. Useful color toners also include dyes such as C.I. solvent red 49, C.I. solvent red 52, C.I. solvent red 109, C.I. basic red 12, C.I. basic red 1 and similar dyes.

In the toner of the present invention, the resin microparticles having an average particle size of 0.05 to 1.0 μm may be attached or cover the surface of the toner particles through mechanical impact force. This improves the cleaning characteristics and heat resistance of the toner.

Examples of useful resin particles include styrene, (meth) acrylic, styrene(meth)acrylic, olefin, fluoride, nitrogen-containing methacrylic, silicon, and benzoguanamine. Other useful resin particles are melamine and similar compounds produced by wet polymerization methods or vapor polymerization methods. These methods include emulsion polymerization, soap-free emulsion polymerization, non-aqueous dispersion polymerization and similar methods.

Resin particles produced by soap-free emulsion polymerization are particularly desirable. Examples of useful devices for attaching resin microparticles to the surface of the toner particles through mechanical impact force include hybridization systems (Nara Machinery Works), atomizers (Nara Machinery Works), and Kriptron (Kawasaki Heavy Industries, Ltd.).

Charge controllers, magnetic microparticles, postprocess agents and similar compounds may be added to the toner of the present invention as necessary.

Useful charge controllers include charge controllers which are generally known in the electrophotographic field.

Examples include negative charge controllers such as salicylic acid metal complexes, naphthenic acid metal complexes, metal complex-type azo dye, organic boron complex, calyx allene compounds, bisphenol S compounds, bisphenol A compounds, fluorine-containing quaternary ammonium salt compounds and similar compounds. Other examples are positive charge controllers such as nigrosine dyes, imidazole compounds, quaternary ammonium salts and similar compounds.

Examples of useful magnetic microparticles include magnetite, hematite, and various ferrites. Charge controllers may be contained within the toner particles, or may be attached to the surface of the toner particles by mechanical impact force.

Fluidizing agents, cleaning enhancers and similar compounds may be used as post-process agents. Examples of useful fluidizing agents include inorganic microparticles such as silica, titania, alumina, and tin oxide used individually or in combinations of two or more. These inorganic microparticles may be subjected to hydrophobic processing with a hydrophobic agent. Such hydrophobic agents include silane coupling agents, titanate coupling agents, aluminum coupling agents, silicone oil and similar compounds.

In addition to the hydrophobic agent, silane coupling agents with fluorine, silicone oil with fluorine, aminosilane coupling agents, and amino silicone oil may be added to regulate the chargeability of the inorganic microparticles. It is desirable that a fluidizing agent is added to the exterior of the toner at a rate of 0.01 to 3 percent-by-weight, and preferably 0.1 to 1 percent-by-weight relative to the toner.

Examples of useful cleaning agents include various resin microparticles such as styrene, (meth) acrylic, styrene(meth) acrylic, olefin, fluoride, nitrogen-containing methacrylic, silicone, benzoguanamine, melamine and similar compounds having an average particle size of 0.05 to 1 μm. Useful cleaning agents are produced by wet polymerization methods or vapor polymerization methods such as emulsion polymerization, soap-free emulsion polymerization, and nonaqueous dispersion polymerization. The cleaning agents are added to the exterior of the toner together with a fluidizing agent.

The toner of the present invention may be used as a two-component developer when combined with a magnetic carrier. Examples of useful magnetic carriers include iron, magnetite, ferrite and similar magnetic particles. Other examples are magnetic particles used as magnetic core particles covered by a resin material to form resin-coated carrier. Magnetic powder dispersed in resin to form a resin dispersion type carrier may also be used.

Examples of resins useful as the coating material include various types of thermoplastic resins and thermoset resins such as polystyrene resins, poly(meth) acrylic resin, polyolefin resin, polyamide resin, polycarbonate resin, polyether resin, polysulfin resin, polyester resin, epoxy resin, polybutyral resins, urea resin, urethane resin, urea resin, silicone resin, teflon resin and similar resins. In addition, mixtures, copolymers, block polymers, graft polymers, and polymer blends of these resins may be used.

Resin having various types of polar groups may also be used to regulate charging characteristics. Among these resins, thermosetting silicone resins are desirable and thermosetting acrylic silicone resins are preferred. Although these resins may be used as a resin for a resin dispersion carrier, polyester resins and styrene-acrylic resins are particularly desirable for this purpose. The weight-average particle size of the magnetic carrier is 20 to 80 μm, and preferably 30 to 60 μm.

The present invention also relates to a flash fusion toner containing at least carbon black graft polymer. The content of the carbon black polymer component is preferably 5 to 20 percent-by-weight relative to the toner.

The carbon black graft polymer used in the present invention is obtained by reacting carbon black and a polymer which is reactive with carbon black. This reactivity uses a functional group present on the surface of the carbon black, e.g., —OH, —COOH, =C=O and similar functional groups.

Carbon black and a polymer containing one or more types of reactive groups which readily react with the aforesaid functional groups is mixed. Reactive groups include carboxyl groups, phosphoric acid groups, amino groups, azolidenes, oxazolines, N-hydroxyalkylamide groups, epoxy groups, thioepoxy groups, isocyanate groups, vinyl groups, and silicone hydrolyric groups.

The carbon black and polymer are desirably mixed in a proportion of, for example, 1 to 3,000 parts-by-weight, and preferably 5 to 1,000 parts-by-weight, of polymer having reactivity to carbon black relative to 100 parts-by-weight of carbon black. Temperature conditions are desirably 200° to 350° C., and preferably 50° to 300° C. If desired, 0 to 1,000 parts-by-weight of polymer which is unreactive to carbon black, 0 to 200 parts-by-weight of polymerizable monomer, and 0 to 1,000 parts-by-weight of organic solvent may be added.

In the reaction, the presence of a reactive group within the polymer is an essential factor. When the reactive group is an isocyanate group, the moisture content of the carbon black inhibits the progress of a smooth reaction. It is necessary to first dehydrate the material by a heating. When the reactive group is an epoxy group, it is necessary to use carbon black with a pH in a range less than 8, and preferably less than 6, because a high pH carbon black will reduce reactivity.

When the reactive group is an aziridene group or oxazoline group, a broad range of carbon blacks may be used. Heating and preprocessing are unnecessary and, thus, these reactive groups are most desirable. Carbon black pH is tested by the method prescribed in Japanese Industrial Standard (JIS) K6221.

Detailed methods for producing the carbon black polymer are described in Japanese Unexamined Patent Application No. HEI 5-241378, with particular reference to the third column paragraph [0012] to twenty-third column paragraph [0038] the contents of which are hereby incorporated by reference.

In the present invention, the carbon black graft polymer is desirably converted to a carbon black component at a rate of 5 to 20 percent-by-weight, and preferably 5 to 15 percent-by-weight, of the total amount of toner. When an inadequate amount of carbon black graft polymer is added, suitable image density cannot be obtained. When an excessive amount of graft polymer is added, image density becomes saturated to maximum darkness, and toner chargeability is adversely affected.

The toner contains at least a thermoplastic resin and carbon black graft polymer. It may be formed by, for example, suspension polymerization, pulverization, microcapsulation, spray drying, mechanochemical, or other well known methods.

When toner is produced by a pulverization method, for example, toner can be produced by mixing carbon black graft polymer with a thermoplastic resin such as polystyrene, poly(meth) acrylate, styrene-(meth) acrylate copolymer, polyester or similar resin. Charge controller and anti-offset agent are added as desired. The mixture is then kneaded and the material is classified.

When toner is produced by a suspension polymerization method, for example, toner can be produced by conventional suspension polymerization. This is accomplished by dissolving/dispersing a carbon black graft polymer in a monomer such as styrene, n-butylacrylate or a similar compound. The material is then suspended in water to polymerize the monomer in a suspension state.

When the spray drying method or mechanochemical method is used to produce the toner, a conventional method may be employed while using a carbon black graft polymer rather than carbon black. In this case, the amount of carbon black graft polymer used may be an amount commensurate with the previously stated value converted for the carbon black component in the toner.

In the other carbon black graft polymer of the present invention, the dispersion-average particle size of carbon black in the toner is desirably in a range of primary particle to 0.5 μm, and preferably primary particle to 0.2 μm.

The size of the ultimately obtained toner is desirably in the range of a weight-average particle size D of 2 to 15 μm. When the object is to obtain high quality images, the particle distribution is such that the weight-average particle size D should be 2 to 9 μm, and preferably 3 to 8 μm. Ideally, the percentage by weight component greater than double (2D) the weight-average particle size D will be less than 1%. In addition, the number percentage component less than ⅓ (D/3) the weight-average particle size D is desirably less than 5%.

It is generally known that image quality is improved as the toner particle size becomes smaller. In the present invention, high quality images can be obtained using small size toner particles without adversely affecting image texture or reducing fine line reproducibility.

This reduction of fine line reproducibility is caused by reflocculation of the carbon black during flash fusion. It is a result of the reduced dispersability of carbon black that occurs when a conventional small size toner has a high load of carbon black. This result is believed to occur because the toner of the present invention has a fine dispersion of the carbon black component in the thermoplastic resin in relation to the graft polymer component of the carbon black graft polymer. The graft polymer prevents the flocculation of the carbon black component during flash fusion.

According to the present invention, it is possible to accurately reproduce fine lines of latent images formed on a photosensitive member. The invention also provides excellent reproducibility of dot latent images such as halftone dots and digital images to produce images with excellent resolution and halftones.

Even when making continuous copies or printouts, it is possible to obtain excellent images while reliably consuming less toner than in the case of conventional toners. As a result, the invention has excellent economic characteristics. The excellent economy is a factor following the toner of the present invention to use less toner than conventional toner when producing identical image densities.

The toner of the present invention further maintains stable long-term chargeability. That is, when the present invention is used as a two-component developer, the toner containing carbon black graft polymer has a uniform dispersion of carbon black. As a result, toner particles adhere to the surface of the carrier particles without becoming spent. This maintains stable long-term triboelectric chargeability.

On the other hand, when used as a monocomponent developer, the toner of the present invention containing carbon black graft polymer also provides excellent carbon black diapersability. As a result, in typical monocomponent systems, there is invariably low toner flocculation on the thin-layer regulating member.

The present invention is described hereinafter by way of examples.

Carbon Black Graft Polymer Example 1

8 parts-by-weight (hereinafter "pbw") benzoylperoxide was dissolved in polymerizable monomer. The monomer comprised 98 pbw styrene and 2 pbw isopropenyloxazoline in 200 pbw deionized water in which was dissolved 0.1 pbw vinyl alcohol. The mixture was loaded in a flask provided with a mixing device, an inert gas inlet tube, a reflux condenser, and a thermometer. The mixture was mixed at high speed to obtain a uniform suspension fluid.

The suspension was heated to 80° C. as nitrogen gas was introduced. The material was mixed continuously for 5 hours during the polymerization reaction. The material was cooled to obtain a polymer suspension fluid. After repeated filtering and washing, a polymer containing oxazoline group was obtained as a reaction group.

20 pbw carbon black (MA-100S; pH 3.2; Mitsubishi Chemicals, Ltd.) was added to 40 pbw of the polymer. The material was kneaded using three rollers at 170° and cooled. It was then pulverized in a feather mill to obtain carbon black graft polymer A.

Carbon Black Graft Polymer Example 2

Deionized water containing 0.1 percent-by-weight (hereinafter referred to as "wt %") polyvinyl alcohol was loaded into a reaction chamber. The reaction chamber had a mixing device, an inert gas inlet tube, a reflux condenser, and a thermometer. 10 pbw glycidyl methacrylate, 60 pbw styrene, 30 pbw. butylmethacrylate, and 5 pbw benzoylperoxide were added to the reaction chamber.

The material was mixed at high speed to obtain a uniform suspension. The suspension was heated to 80° C. as nitrogen gas was introduced. The material was mixed continuously for 5 hours during the polymerization reaction. The water was then removed to obtain a polymer containing an epoxy group as a reaction group.

40 pbw carbon black (MA-100; pH 3.5; Mitsubishi Chemicals, Ltd.) was added to 100 pbw of the polymer containing an epoxy group as a reaction group. The material was mixed to achieve adequate uniformity and kneaded using a heat/pressure roller at 160° C. The kneaded material was quickly cooled to 40° C. It was then pulverized in a feather mill to obtain carbon black graft polymer B.

Carbon Black Graft Polymer Example 3

Carbon black graft polymer C was produced in the same manner as the carbon black graft polymer in example 1 with the exception that the carbon black (MA-100S) was changed to carbon black, (MA-100; pH 3.5; Mitsubishi Chemicals, Ltd.).

Carbon Black Graft Polymer Example 4

Carbon black graft polymer D was obtained in the same manner as the carbon black graft polymer in example 2 with the exception that the carbon black (MA-100) was changed to carbon black (MA0100R; pH 3.4; Mitsubishi Chemicals, Ltd.) to which was added 5 pbw low molecular weight polypropylene (Biscol 660P; Sanyo Kagaku Kogyo K. K.).

Carbon Black Graft Polymer Example 5

217 pbw toluene was added to a flask provided with a drip rod, a mixing device, an inert gas inlet tube, a reflux condenser, and a thermometer. The flask was heated to 90° C. as nitrogen gas was introduced.

4.6 pbw mercaptoethanol was mixed with 1.32 pbw azobisisobutylonitrile dissolved in a previously prepared polymerizable polymer. The polymer was comprised of 480 pbw styrene and 20 pbw butylacrylate. The mixture was dripped from a rod over a 2 hour period and mixed continuously for 5 hours to accomplish a polymerization reaction.

0.1 g dibutyl tin dilaurate and 2.38 g of 2,4-toluenediisocyanate were added to 185.1 g of the reaction product (containing prepolymer having a terminal hydroxyl group). The mixture was reacted for 30 min at 80° C. to obtain a solution of a polymer having a terminal isocyanate group.

57.1 pbw polymerizable solution with an isocyanate group as a terminal reaction group was mixed with 20 pbw carbon black (MA-100S; pH 3.2; Mitsubishi Chemicals, Ltd.). The carbon black was previously predried for 2 hours at 200° C. The mixture was kneaded using a Labo-blust mill to achieve a reaction and desolvation. The material was then cooled and pulverized to obtain carbon black graft polymer E.

Toner Example 1

150 pbw styrene was mixed with 9 pbw low molecular weight polyethylene (Mitsui HiWax 200P; molecular weight: 2,000; softening point: 130° C.; viscosity: 0.97; Mitsui Sekiyu Kagaku Kogyo K. K.) and 1 pbw graft transformed wax (Mitsui HiWax 1140H; molecular weight 2,100; softening point 103° C.; viscosity: 0.97; Mitsui Sekiyu Kagaku Kogyo K. K.).

The mixture was loaded into an autoclave for nitrogen replacement and heated to 120° C. while being mixed. After the wax component in the styrene was dissolved, the mixture was quickly cooled to 40° C. This left liquid mixture A from which the wax component in the styrene had been separated out.

Deionized water containing 0.5 wt % of dodecylbenzene sodium sulfonate as an anionic surface active agent was prepared. This solution was loaded into a reaction chamber with an inert gas inlet tube, a reflux condenser, and a thermometer. A mixture of 160 pbw liquid mixture A, 60 pbw n-butylacrylate, 90 pbw carbon black graft polymer A, and 3 pbw 2-2'azobisisobutylonitrile was added to the reaction chamber.

The mixture was mixed using a T. K. Autohomogenizer mixer (Tokusyuki-Kakogyou-sya) to produce a uniform suspension. The material was heated to 65° C. under the introduction of blown inert nitrogen gas. The material was continuously mixed for 5 hours at this temperature to produce a suspension polymerization reaction. It was then heated to 75° C. to complete the polymerization reaction.

Separately, 2 pbw hydrophobic silica (R974; BET specific surface area 170 $m^2/g$; primary particle size 12 μm; Nippon Aerosil Co. Ltd.) and 2 pbw silane coupling agent (TSL 8311; Toshiba Silicone, Ltd.) were dispersed in methyl alcohol. These dispersions were added to the suspension fluid. The fluid was allowed to stand for 5 hours at 60° C. and 80% relative humidity using a hot air drier.

The charge controller (E-84; particle size: 0.2 Orient Chemicals, Ltd.) and hydrophobic silica (H2000; BET specific surface area 140 $m^2/g$; primary particle size: 14 Wakker Co. Ltd.) were added to 100 pbw of the suspension fluid. The mixture was mixed for 1 min at 2,000 rpm in a Henschel mixer.

The suspension polymerization flocculant was cracked using a Kriptron Cosmos model KTM-0 set at 0° C. inlet temperature. Charge controller and hydrophobic silica were attached to the surface of the cracked particles. The material was air classified to obtain colorant particles A. 0.2 pbw hydrophobic silica H2000 (Wakker Co. Ltd.) was added to 100 pbw colorant particle A. The material was mixed for 1 min at 2,000 rpm in a Henschel mixer to obtain toner A.

Toner Example 2

150 pbw styrene was mixed with 8 pbw low molecular weight polyethylene (Mitsui HiWax 400P; molecular weight: 4,000; softening point: 136° C.; viscosity: 0.98; Mitsui Sekiyu Kagaku Kogyo K. K.) and 0.5 pbw graft transformed wax (Mitsui HiWax 3010R; molecular weight 3,100; softening point 128° C.; viscosity: 0.98; Mitsui Sekiyu Kagaku Kogyo K. K.).

The mixture was loaded into an autoclave for nitrogen replacement and heated to 125° C. while being mixed. After the wax component in the styrene was dissolved, the mixture was quickly cooled to 40° C. to obtain liquid mixture B from which the wax component in the styrene had been separated out.

Deionized water containing 0.5 wt % of dodecylbenzene sodium sulfonate as an anionic surface active agent was loaded into a reaction chamber. The reaction chamber had an inert gas inlet tube, a reflux condenser, and a thermometer. A mixture of 158.5 pbw liquid mixture B, 20 pbw n-butylacrylate, 70 pbw carbon black graft polymer B, and 3 pbw 2-2'azobisisobutylonitrile was added to the reaction chamber.

The mixture was mixed using a T. K. Autohomogenizer mixer (Tokusyuki-Kakogyou-sya) to produce a uniform suspension. The material was heated to 65° C. under the introduction of blown inert nitrogen gas. The material was continuously mixed for 5 hours at this temperature to produce a suspension polymerization reaction. It was then heated to 75° C. to complete the polymerization reaction.

Separately, 1 pbw hydrophobic silica (H2000; Wakker Co. Ltd.), 1 pbw charge controller (E-84: Orient Chemicals, Ltd.), and 2 pbw silane coupling agent (TSL 8311; Toshiba Silicone, Ltd.) were dispersed in methyl alcohol. These dispersions were then added to the suspension fluid. The suspension fluid was repeatedly filtered and washed. It was then dried and air classified to obtain colorant particles B.

0.1 pbw hydrophobic silica (H2000; Wakker Co. Ltd.), and 0.2 pbw hydrophobic titanium oxide (T-805; BET specific surface area: 30 $m^2/g$; primary particle size: 30 μm; Nippon Aerosil Co. Ltd.) were added to 100 pbw colorant particle B. The material was mixed for 2 min at 2,000 rpm in a Henschel mixer to obtain toner B.

Toner Example 3

Deionized water containing 0.5 wt % of dodecylbenzene sodium sulfonate as an anionic surface active agent was loaded into a reaction chamber. The reaction chamber had an inert gas inlet tube, a reflux condenser, and a thermometer. A mixture of 150 pbw styrene, 20 pbw n-butylacrylate, 70 pbw carbon black graft polymer B, and 3 pbw 2-2'azobisisobutylonitrile was added to the reaction chamber.

The mixture was mixed using a T. K. Autohomogenizer mixer (Tokusyuki-Kakogyou-sya) to produce a uniform suspension. The material was heated to65° C. under the introduction of blown inert nitrogen gas. The material was continuously mixed for 5 hours at this temperature to produce a suspension polymerization reaction. It was then heated to 75° C. to complete the polymerization reaction.

Separately, 1 pbw hydrophobic silica (H2000; Wakker Co. Ltd.), 1 pbw charge controller (E-84: Orient Chemicals, Ltd.), and 2 pbw silane coupling agent (TSL 8311; Toshiba Silicone, Ltd.) were dispersed in methyl alcohol. These dispersions were then added to the suspension fluid. The suspension fluid was repeatedly filtered and washed. It was then dried and air classified to obtain colorant particles C.

0.1 pbw hydrophobic silica (H2000; Wakker Co. Ltd.) and 0.2 pbw hydrophobic titanium oxide (T-805; Nippon Aerosil Co. Ltd.) were added to 100 pbw colorant particle C. The material was mixed for 2 min at 2,000 rpm in a Henschel mixer to obtain toner C.

Toner Example 4

Deionized water containing 0.5 wt % of dodecylbenzene sodium sulfonate as an anionic surface active agent was loaded into a reaction chamber. The reaction chamber had an inert gas inlet tube, a reflux condenser, and a thermometer. A mixture of 80 pbw styrene, 20 pbw n-butylacrylate, 10 pbw carbon black MA-100 (Mitsubishi Chemicals, Ltd.), 3 pbw low molecular weight polypropylene wax (Biscol 660P; molecular weight: 3,000; softening point: 145° C.; viscosity: 0.89; Sanyo Kasei Kogyo K. K.), and 3 pbw 2-2'azobisisobutylonitrile was added to the reaction chamber.

The mixture was mixed using a T. K. Autohomogenizer mixer (Tokusyuki-Kakogyou-sya) to produce a uniform suspension. The material was heated to65° C. under the introduction of blown inert nitrogen gas. The material was continuously mixed for 5 hours at this temperature to produce a suspension polymerization reaction. It was then heated to 75° C. to complete the polymerization reaction.

Separately, 1 pbw hydrophobic silica (H2000; Wakker Co. Ltd.), 1 pbw charge controller (E-84: Orient Chemicals, Ltd.), and 2 pbw silane coupling agent (TSL 8311; Toshiba Silicone, Ltd.) were dispersed in methyl alcohol. These dispersions were then added to the suspension fluid. The suspension fluid was repeatedly filtered and washed. It was then dried and air classified to obtain colorant particles D.

0.1 pbw hydrophobic silica (H2000; Wakker Co. Ltd.), and 0.2 pbw hydrophobic titanium oxide (T-805; Nippon Aerosil Co. Ltd.), were added to 100 pbw colorant particle D. The material was mixed for 2 min at 2,000 rpm in a Henschel mixer to obtain toner D.

Toner Examples 5 through 7

3 pbw low molecular weight polypropylene wax (Biscol 660P; Sanyo Kasei Kogyo) was mixed with 100 pbw colorant particles C obtained in toner example 3. The mixture was loaded in a Henschel mixer and mixed for 1 min at 1,000 rpm. It was heated to a maximum temperature of 140° C. The mixture was then kneaded by a dual-shaft extrusion kneader heated to a discharge temperature of 100° C.

The kneaded material was allowed to rest to cool. It was then coarsely pulverized to a diameter of less than 1 mm using a feather mill. It was finely pulverized and coarsely powdered using a jet mill (model MDS 2; Japan Pneumatic). The material was then finely powdered using a classification device (Deeplex 50ATP).

The fine pulverization and classification conditions were varied to obtain colorant particles E through G. The colorant particles E through G had different particle size distributions and different average particle sizes.

0.1 pbw hydrophobic silica (H2000; Wakker Co. Ltd.), and 0.2 pbw hydrophobic titanium oxide (T-805; Nippon Aerosil Co. Ltd.) were added to 100 pbw of each of the obtained colorant particles E through G. Each mixture was mixed in a Henschel mixer for 2 min at 2,000 rpm to obtain toners E through G.

Toner Example 8

Colorant particles H were obtained in the same way as described in toner example 5 with the exception that the wax used was changed to a low molecular weight polyethylene (Mitsui HiWax 200P; Mitsui Petroleum Chemical Industries, Ltd.) Colorant particles H were used in a post-process identical to the process of toner example 5 to obtain toner H.

Toner Example 9

A mixture of 100 pbw polyester resin (NE-382; Ltd.) and 4 pbw cyan pigment (C.I. Pigment blue 15-3; Toyo Ink, Ltd.) was thoroughly mixed in a ball mixer. The mixture was then kneaded under three rollers heated to 140° C. It was then allowed to stand to cool and coarsely pulverized using a feather mill.

2 pbw low molecular weight polyethylene (Mitsui HiWax 200P; Mitsui Petroleum Chemical Industries, Ltd.), and 0.5 pbw graft transformed wax (Mitsui HiWax 1160H; molecular weight 1,500; softening point: 105° C.; viscosity: 1.00; Mitsui Petroleum Chemical Industries, Ltd.) were added to 100 pbw of the coarsely pulverized material. The mixture was thoroughly mixed using a ball mixer. 500 pbw toluene was added to the mixture. The material was heated to 80° C. while mixing continuously to completely dissolved the wax component in the toluene.

Separately, 60 pbw of 4% solution of methyl cellulose (Methocel 35LV; Dow Chemical, Inc.) as a dispersion stabilizer, 5 pbw of 1% solution of dioctylsulfosuccinate soda (Nikkol; OTP75; Niko Chemicals, Ltd.), and 0.5 pbw hexametaphosphate soda (Wako Pure Chemical Industries, Ltd.) were dissolved in 1,000 pbw ion exchange water to regulate the aqueous solution which was thereafter stored at 5° C.

The solution containing dissolved/dispersed toner component was loaded in heated toluene obtained from the aqueous solution. The solution was strongly mixed using a TK autohomogenizer mixer (Tokusyuki-Kakogyou-sya) to obtain a uniform distribution. The material was then stabilized at 60° C. The number of revolutions was regulated to obtain suspension particles 3 to 10 μm in size suspended in the solution.

0.5 pbw hydrophobic silica (R-974; Nippon Aerosil Co. Ltd.) was mixed with 0.5 pbw calyx allene compound (E-89; particle size: 0.2 μm; Orient Chemical Industries, Ltd.) previously dispersed in methanol in a sufficient particle state. The mixture was added to 100 pbw color resin and mixed. This mixture was strongly agitated using an ultrasonic vibrator.

The mixture was repeatedly filtered and washed. The particles were dried using a slurry drier (Slurry Drier: Nissin Engineering Co. Ltd.) and air classified to obtain colorant particles I. 0.3 pbw hydrophobic silica (H2000; Wakker Co. Ltd.) and 0.5 pbw hydrophobic titanium oxide (T-805; Nippon Aerosil Co. Ltd.) were added to 100 pbw of colorant particles I. The mixture was mixed for 2 min at 2,000 rpm in a Henschel mixer (Mitsui-Mike Kakogyou-sya) to obtain toner I.

Carrier Example 1

A coating solution was prepared by dissolving 20 pbw acrylic transformed silicone resin KR9706 (Shin-Etsu Chemical Co., Ltd.) in 400 ml of methylethyl ketone. This coating solution was sprayed on Cu—Zn ferrite particles having a mean particle size of 50 μm using a spray coater (Okada Seiko, Ltd). This provided a resin coating on the ferrite particles.

The ferrite particles were then heated to 180° C. for 30 min to harden the resin coating and obtain a carrier coated with acrylic transformed silicone resin. The obtained carrier was cracked using a coarse pulverizer and classified using a 90 μm mesh sieve. The low magnetic force component was removed using electromagnetic separation to obtain resin-coated ferrite carrier A having a mean particle size of 50 μm.

Evaluation (1) Particle Size Measurements

The measurement of toner particle size and size distribution was accomplished using a Coulter Multi-sizer (Coulter Electronics, Inc.) with a 50 μm armature. Measurement results are shown in Table 1.

The measurement of carrier mean particle size was accomplished using a laser type precision distribution measuring device, model SALD-1100 (Shimidzu Seisakusho K. K.).

The relative length ratio, average length, and average diameter of the wax acicular particles were measured with photographic enlargements of observations by transmission electron microscope (TEM). Measurement results are shown in Table 1.

TABLE 1

Observations of Toners A–I

| Toner | Wt-ave particle size (μm) | Content particle size 2D or more (wt %) | Content particle size less than D/3 | Relative length ratio | Wax dispersion Ave length (μm) | Ave dia. (μm) |
|---|---|---|---|---|---|---|
| A | 6.0 | 0 | 3.2 | 28 | 3.08 | 0.11 |
| B | 6.2 | 0.1 | 4.2 | 12 | 1.20 | 0.10 |
| C | 6.2 | 0.1 | 4.8 | — | — | — |
| D | 6.2 | 0.2 | 4.6 | 2 | 0.07 | 0.35 |
| E | 6.2 | 0.1 | 4.8 | 3 | 0.63 | 0.21 |
| F | 6.1 | 0.1 | 8.8 | 3 | 0.57 | 0.19 |
| G | 8.4 | 2.6 | 4.5 | 3 | 0.66 | 0.22 |
| H | 6.2 | 0.1 | 4.6 | 2 | 0.81 | 0.41 |
| I | 6.8 | 1.6 | 4.2 | 8 | 0.88 | 0.11 |

(2) Evaluation Apparatus

The apparatus used for evaluations was a continuous sheet printer using a flash fusion method shown in FIG. 1. In the drawing, a photosensitive drum 1, i.e., an electrostatic latent image carrying member, is at the top right hand area. This drum is driven in rotation in the arrow direction in the drawing by a drive means (not illustrated). Sequentially arranged around the periphery of the photosensitive drum 1 are a corona charger 2, a developing unit 3, a transfer unit 4, a cleaning unit 5, and an eraser 6.

Below the photosensitive drum 1 is an optical unit 7 which comprises a housing 71. Inside the housing, there is a semiconductor laser generator, a polygonal mirror, a toroidal lens, a half mirror, a spherical mirror, a folding mirror, and a reflective mirror. An exposure slit is formed in the housing 71 in the region confronting the photosensitive drum. This slit exposes the surface of the photosensitive drum 1 by a laser emission passing from the exposure slit and between the charger 2 and the developing unit 3.

A paper tray 91 is illustrated at the bottom of the drawing. The paper tray accommodates a continuous folded sheet 10 provided with perforations for cutting the sheets. Sequentially arranged along the paper transport path 9 are a fixing flash 8, two discharge roller pairs 92 and 93, and a discharge tray 94 confronting a discharge roller pair 93.

The surface of the photosensitive drum 1 is uniformly charged to a predetermined potential by a charger 2 according to the printer. This charged region is optically exposed by the optical unit 7 to form an electrostatic latent image. The exposure light which irradiates the surface of the photosensitive drum 1 is emitted based on image information transmitted from a controller 100.

The formed electrostatic latent image is developed as a toner image by reverse development using triboelectrically charged toner of the same polarity as the photosensitive drum accommodated in the developing unit 3. The developed toner image is moved to the transfer region confronting the transfer unit 4. Continuous perforations are provided in the sheet transport direction on both edges of the continuous sheet 10 accommodated in the paper tray 91.

The continuous sheet is automatically fed in stages in a predetermined direction by a stepping motor. The motor engages the perforations with a sprocket device 90. The continuous sheet is fed toward the transfer region along the transport path. At the transfer region, the transfer unit 4 transfers the toner image from the surface of the photosensitive drum 1 onto the sheet. Image transfer occurs by applying an electrostatic charge to the reverse side of the sheet. This electrostatic charge has an opposite polarity compared to the charge polarity of the toner.

After the toner image is fused to the sheet by the fusing flash 8, the sheet is ejected by a discharge roller pair 93 to the discharge tray 94. After the toner image has been transferred to the sheet, the residual toner remaining on the surface of the photosensitive drum 1 is removed by the cleaning unit 5. The residual charge is removed by the eraser 6. Thus, one cycle of the image forming operation ends.

Image formation was conducted under the conditions listed below in the previously described continuous sheet printer.

Photosensitive drum speed: 100 mm/sec

Photosensitive drum surface potential: −650 V

Developing bias: −400 V

Continuous sheet thickness: 8 mil

Developers used: Developers comprising toners A through I and carrier A at a toner density of 4 wt %.

(A) Fixing Strength Evaluation

Fixing strength was measured by rubbing a fixed image sample with an eraser with an applied load of 1 kg. The post erasure image density was measured using a Sakura densitometer model PDA65. The fixing strength was calculated as follows.

Fixing strength={(post erasure image density/pre-erasure image density)×100}

Measurement results are shown in Table 2

(B) Smearing Evaluation

Smearing characteristics were evaluated by stacking a blank white sheet over a sheet having an image. The image was formed with an image density of 1.2 solid image measured using the Sakura densitometer model PDA65. 50 g/cm$^2$ load was applied on the sheets and the sheets were rubbed.

The degree of toner migration to the white sheet was then visually judged. A total lack of toner migration to the white sheet was rated O. Slight toner migration was rated A. Pronounced toner migration to the white sheet, inducing a color change, was rated X. Evaluation results are shown in Table 2.

(C) Image Quality (Dot Reproducibility) Evaluation

A 1-on-1-off print pattern was used. Sheets reproducing 1 dot on/off at equal intervals were rated O. Sheets reproducing distinguishable dots but at uneven spacing were rated Δ. Sheets reproducing dots crowded together were rated X. Evaluation results are shown in Table 2.

(D) Image Fog Evaluation

Toner fogging of the white background of an image was evaluated using a 20× magnifying glass. No toner fog was rated O. Slight toner fog that posed no practical problem was rated Δ. Excessive toner fog making it unusable was rated X. Evaluation results are shown in Table 2.

TABLE 2

Evaluation of Toners A–I

| Toner | Fixing strength (%) | Smearing | Dot reproducibility | Image fog |
|---|---|---|---|---|
| A | 100 | O | O | O |
| B | 100 | O | O | O |
| C | 78 | X | O | O |
| D | 90 | X | O | Δ |
| E | 92 | X | O | Δ |
| F | 89 | X | O | X |
| G | 95 | X | X | X |
| H | 94 | O | O | Δ |
| I | 98 | O | O | O |

Toner Examples 10 through 12

| Components | pbw |
|---|---|
| * Polyester resin (Kao, Ltd.; Tuftone NE-1110) | 100 |
| * Carbon black graft polymer C | 21 |
| * Charge controller (Orient Chemical Industries, Ltd.; E-84) | 3 |
| * Anti-offset agent (Sanyo Kasei Kogyo; Biscol TS200) | 3 |

After the materials were thoroughly mixed in a ball mill, they were kneaded by three rollers heated to 110° C. The kneaded material was allowed to stand to cool. It was then coarsely pulverized and finely pulverized using a jet mill. The material was air classified to obtain colorant J having a mean particle size of 8 μm.

0.2 pbw hydrophobic silica H2000 (Wakker Co. Ltd.) and 0.3 pbw hydrophobic titanium T-805 (Nippon Aerosil Co. Ltd.) were added to 100 pbw of colorant particles J. The material was thoroughly mixed using a Henschel mixer to obtain toner J (weight-average particle size D: 8.2 μm; particle content less than D/3: 4.8 wt %; particle content greater than 2D: 0.4 wt %). The mean particle size of the carbon black of toner J was 0.18 μm.

The same method was used to produce toner K (weight-average particle size D: 8.1 μm; particle content less than D/3: 4.6 wt %; particle content greater than 2D: 0.5 wt %; carbon black distribution-average particle size: 0.20 μm) with the exception that the amount of added carbon black graft polymer was 26 pbw.

The same method was used to produce toner L (weight-average particle size D: 8.2 μm; particle content less than D/3: 4.6 wt %; particle content greater than 2D: 0.3 wt %; carbon black distribution-average particle size: 0.18 μm) with the exception that the amount of added carbon black graft polymer was 32 pbw.

Toner particle size and particle size distribution was measured using a Coulter Multi-sizer (Coulter Electronics, Inc.) with a 50 μm armature. The distribution-average particle size of the carbon black was measured by photographic enlargements of observations by transmission electron microscopy (TEM) of the toner particle cross section.

Toner Example 13

Deionized water containing 0.5 wt % of dodecylbenzene sodium sulfonate as an anionic surface active agent was loaded into a reaction chamber. The reaction chamber had an inert gas inlet tube, a reflux condenser, and a thermometer. A mixture of 80 pbw preadjusted styrene, 50 pbw carbon black graft polymer E in a polymerizable component comprising 20 pbw n-butylacrylate, 3 pbw azobisisobutylonitrile, and 3 pbw 2-2'azobisisobutylonitrile was added to the reaction chamber.

The mixture was mixed using a T. K. Autohomogenizer mixer (Tokosyuki-Kakogyou-sya) to produce a uniform suspension. The material was heated to 65° C. under the introduction of blown inert nitrogen gas. The material was continuously mixed for 5 hours at this temperature to produce a suspension polymerization reaction. It was then heated to 75° C. to complete the polymerization reaction.

Separately, 2 pbw hydrophobic silica (H2000; Wakker Co. Ltd.), and 2 pbw silane coupling agent (TSL 8311; Toshiba Silicone, Ltd.) were dispersed in methyl alcohol. These dispersions were then added to the suspension fluid. The suspension fluid was allowed to stand for 5 hours under conditions of 80% relative humidity and 70° C. using a hot air drier. Another sample was dried for 5 hours under conditions of 50° C. and 80% relative humidity.

100 pbw of the suspension polymerization flocculant, 0.5 pbw charge controller (E-84; Orient Chemical Industries, Ltd.), and 0.1 pbw hydrophobic silica (H2000; Wakker Co. Ltd.) were mixed in a Henschel mixer. The mixture was then cracked using a Kriptron Cosmo model KTM-0 (Kawasaki Heavy Industries, Ltd.). The inlet temperature was set at 0° C. to attach the charge controller. The material was air classified to obtain colorant M having a mean particle size of 6.0 μm.

0.2 pbw hydrophobic silica R-972 (Nippon Aerosil Co. Ltd.) and 0.4 pbw hydrophobic titanium oxide SST-30A (Titan Co. Ltd.) were added to 100 pbw of colorant particles M. The mixture was mixed in a Henschel mixer (Mitsui-Mike Kakogyou-sya) for 1 min at 2,000 rpm to obtain toner M (weight-average particle size D: 6.0 μm; particle content less than D/3: 3.8 wt %; particle content greater than 2D: 0.4 wt %; carbon black distribution-average particle size: 0.10 μm).

Toner Example 14

A mixture of 100 pbw polyester resin (NE-382; Kao, Ltd.) and 15 pbw carbon black graft polymer D was thoroughly mixed using a ball mill. The mixture was then kneaded using three rollers heated to 140° C. After the kneaded material was allowed to stand to cool, it was coarsely pulverized using a feather mill. 100 pbw of the coarse pulverized material was dissolved in 400 pbw solution of methylene/toluene (8/2).

60 pbw of 4% solution of methyl cellulose (Methocel 35LV; Dow Chemical, Inc.) as a dispersion stabilizer, 5 pbw of 1% solution of dioctylsulfosuccinate soda (Nikkol; OTP75; Niko Chemicals, Ltd.), and 0.5 pbw hexametaphosphate soda (Wako Pure Chemical Industries, Ltd.) were dissolved in 1,000 pbw ion exchange water to regulate the aqueous solution. The solution was mixed using a TK autohomogenizer mixer (Tokusyuki-Kakogyou-sya). The number of revolutions was regulated to obtain suspension particles of 3 to 10 μm in size suspended in the solution.

A mixture of 0.5 pbw calyx allene compound (E-89; Orient Chemical Industries, Ltd.) previously dispersed in methanol in a sufficient particle state, and 0.5 pbw hydrophobic silica (R-974; Nippon Aerosil Co. Ltd.) was added to 100 pbw color resin and mixed.

This mixture was strongly agitated using an ultrasonic vibrator. After repeated filtering and washing, the particles were dried using a slurry drier (Dispacote; Nissin Engineering Co. Ltd.). The particles were then air classified to obtain colorant particles having a mean particle size of 6.2 μm.

0.3 pbw hydrophobic silica (H2000; Wakker Co. Ltd.), and 0.5 pbw hydrophobic titanium oxide (T-805; Nippon Aerosil Co. Ltd.) were added to 100 pbw of the colorant particles. The mixture was mixed for 1 min at 1,000 rpm in a Henschel mixer (Mitsui-Mike Kakogyou-sya) to obtain toner N (weight-average particle size D: 6.2 μm; particle content less than D/3: 4.9 wt %; particle content greater than 2D: 0.7 wt %; carbon black distribution-average particle size: 0.18 μm).

Toner Examples 15 through 17

Toners O through Q having a mean particle size of 7.0 μm were obtained by the same combinations and methods as in toner example 10 with the exception that 8, 10, and 12 pbw carbon black (MA100; Mitsubishi Chemicals, Ltd.) was used instead of carbon black graft polymer C.

TABLE 3

Evaluation of Toners O–Q

| | Toner O | Toner P | Toner Q |
|---|---|---|---|
| Content of particles less than D/3 | 5.2 number % | 4.8 number % | 5.4 number % |
| Content of particles above 2D | 0.8 wt % | 0.7 wt % | 1.2 wt % |
| Mean particle size of carbon black | 0.6 μm | 0.7 μm | 1.0 μm |

Carrier Example 2

| Component | pbw |
|---|---|
| * polyester resin (Tuftone NE1110; Kao, Ltd.) | 100 |
| * Magnetic powder (MA#8; Mitsubishi Chemicals, Ltd.) | 2 |

The components were mixed in a Henschel mixer, kneaded in a dual-shaft extrusion kneader, cooled, and coarsely pulverized. The coarse pulverized material was then finely pulverized in a feather mill. The material was classified using an air classifier to obtain a binder type carrier B having a mean particle size of 50 μm.

Evaluations

Toner evaluation was accomplished using developers which combine toners and carriers as shown in Table 4 below.

(1) Evaluation Apparatus

The apparatus used for evaluations was the continuous sheet printer using a flash fusion method shown in FIG. 1. Image forming conditions were identical to those previously stated.

(2) Image Density

Image density was determined by measuring the density of a solid image using a Sakura model PDA65 densitometer. Stable reproduction of a density of 1.3 was rated O.

(3) Image Quality

Dot Reproducibility

A halftone total surface print pattern of 0.6 image density was used. Image quality was evaluated in four levels by microscopic examination (100×).

⊕: Equal dot diameters and intervals between dots

○: Slight dot thickening/thinning

Δ: Dot thickening/thinning but no loss of dots or connected dots

X: Connected dots or missing dots

Fine Line Reproducibility

Fine line reproducibility was evaluated in four levels by the degree of reproduction of 1-on 1-off lines viewed under a microscope (100×).

⊕: Equal line width and spacing between lines with little toner dispersion around the lines ○: Slight loss of line smoothness with slight toner dispersion around lines, but equal line width and spacing between lines Δ: 1-on 1-off dots discernable X: 1-on 1-off not discernable Nonprinting spots Nonprinting spots were evaluated in three levels. A square solid black pattern was used with a density of 0.8. After fixing, the image was examined under a microscope (100×).

○: No nonprinting spots

Δ: Some nonprinting spots, but not a practical problem

X: Nonprinting spots render toner impractical

Image Fog

Image fog was evaluated in three levels. A 20× magnifying glass was used to examine toner fog in the white background of the image.

○: No fog

Δ: Slight fog, but not a practical problem

X: Severe fog

Among the image evaluations, dot reproducibility and fine line reproducibility were performed before and after image fixing. Image quality deterioration was evaluated during flash fusion.

(4) Evaluation of Image Density Relative to Toner Consumption

The amount of adhered toner (mg/cm$^2$) required to achieve an image density of 1.2 was evaluated.

TABLE 4

Evaluation of Toners J–Q

| toner | carrier | image density (ID) | fog | non-printing dots | prefixing dot reproducibility | prefixing line reproducibility | post fixing dot reproducibility | post fixing line reproducibility | anti of adhered toner (ID 1.2) |
|---|---|---|---|---|---|---|---|---|---|
| J | B | ○ | ○ | ○ | ○ | ○ | ○ | ○ | 0.54 |
| K | B | ○ | ○ | ○ | ○ | ○ | ○ | ○ | 0.45 |
| L | B | ○ | ○ | ○ | ○ | ○ | ○ | ○ | 0.42 |
| M | A | ○ | ○ | ○ | ⊕ | ⊕ | ⊕ | ⊕ | 0.42 |
| N | A | ○ | ○ | ○ | ⊕ | ⊕ | ⊕ | ⊕ | 0.44 |
| O | B | ○ | ○ | Δ | ○ | ○ | Δ | Δ | 0.77 |

TABLE 4-continued

Evaluation of Toners J–Q

| toner | carrier | image density (ID) | fog | non-printing dots | prefixing dot reproduc-ibility | prefixing line reproduc-ibility | post fixing dot reproduc-ibility | post fixing line reproduc-ibility | anti of adhered toner (ID 1.2) |
|---|---|---|---|---|---|---|---|---|---|
| P | B | ○ | Δ | X | Δ | Δ | X | X | 0.62 |
| Q | B | ○ | Δ | X | Δ | Δ | X | X | 0.58 |

What is claimed is:

1. A toner for use in a non-contact heat fusing apparatus comprising:

a binder resin;

a colorant; and acicular particles of wax.

2. The toner of claim 1, wherein the acicular particles have a relative length ratio of from about 5 to 40, an average diameter of from about 0.005 to about 0.5 micrometer, and an average length of from about 0.5 to about 8 micrometers.

3. The toner of claim 2, wherein the acicular particles have a relative length ratio of from about 8 to 30, an average diameter of from about 0.05 to about 0.3 micrometer, and an average length of from about 1.0 to about 4.0 micrometers.

4. The toner of claim 1, wherein the wax is a polyolefin wax.

5. The toner of claim 4, wherein the wax has a softening point of about 80° to about 150° C. and a molecular weight of about 800 to about 10,000.

6. The toner of claim 1, wherein the amount of the wax is about 0.5 to about 5 parts-by-weight relative to 100 parts-by-weight of the binder resin.

7. The toner of claim 1, wherein the wax is a grafted transformed polyolefin wax obtained by graft polymerization of a polymerizable monomer to a polyolefin wax.

8. The toner of claim 1, wherein the toner has a weight-average particle size of from about 2 to about 9 micrometers.

9. The toner of claim 8, wherein the percentage by weight greater than double 2D is less than 2% and the percentage by number less the ⅓ D is less than 5%, said D representing the weight-average particle size of the toner.

10. The toner of claim 1, wherein the toner is produced by a wet granulation method in which the toner is granulated in an aqueous solution and then the solution is removed to obtain the toner.

11. A method for preparing a toner for use in forming an electrostatic latent toner image comprising combining acicular particles of a polyolefin wax, a colorant and a binder resin to form the toner recited in claim 1.

12. The method for preparing a toner as recited in claim 11, wherein polyolefin wax is mixed with a polymerizable monomer to form a mixture, the mixture is heated to melt the wax, the mixture is then cooled to separate out the polyolefin wax as said acicular particles of polyolefin wax, said colorant is added to said mixture, the mixture is formed into particles and the polymerizable monomer is polymerized into a binder resin.

13. A method for forming a toner image comprising charging the surface of a photosensitive drum; exposing said charged surface to radiation; developing a toner image with the toner which comprises acicular particles of a polyolefin wax, colorant and a binder resin recited in claim 1; and transferring said toner image from the surface of said drum onto a sheet.

14. A toner for use in a non-contact heat fusing apparatus comprising:

a binder resin;

acicular particles of wax; and a carbon black graft polymer obtained by reacting carbon black with a polymer which is reactive with carbon black.

15. The toner of claim 14, wherein the acicular particles have a relative length ratio of from about 5 to about 40, an average breadth diameter of from about 0.005 to about 0.5 micrometer, and average length of from about 0.5 to about 8 micrometers.

16. The toner of claim 14, wherein the carbon black graft polymer has a dispersion particle size not greater than about 0.5 micrometer.

17. The toner of claim 14, wherein the toner has a weight-average particle size of from about 2 to about 9 micrometers.

18. The toner of claim 17, wherein the percentage by weight greater than double 2D is less than 2% and the percentage by number less the ⅓ D is less than 5%, said D representing the weight-average particle size of the toner.

19. A method for preparing a toner for use in forming an electrostatic latent toner image comprising combining acicular particles of a polyolefin wax, a carbon black graft polymer obtained by reacting carbon black with a polymer which is reactive with carbon black and a binder resin to form the toner recited in claim 14.

20. The method for preparing a toner as recited in claim 19, wherein polyolefin wax is mixed with a polymerizable monomer to form a mixture, the mixture is heated to melt the wax, the mixture is then cooled to separate out the polyolefin wax as said acicular particles of polyolefin wax, said colorant is added to said mixture, the mixture is formed into particles and the polymerizable monomer is polymerized into a binder resin.

21. A method for forming a toner image comprising charging the surface of a photosensitive drum; exposing said charged surface to radiation; developing a toner image with the toner which comprises acicular particles of a polyolefin wax, colorant and a binder resin recited in claim 14; and transferring said toner image from the surface of said drum onto a sheet.

22. The toner of claim 14, wherein the carbon black graft polymer is converted to the carbon black component at a ratio of from about 5 to about 20 percent weight.

* * * * *